US006142330A

United States Patent [19]

Sacks

[11] Patent Number: 6,142,330

[45] Date of Patent: Nov. 7, 2000

[54] LOCKING RING FOR CONTAINERS

[75] Inventor: Ralph Sacks, Chicago, Ill.

[73] Assignee: Lunt Investments Corporation, Rosemont, Ill.

[21] Appl. No.: 09/379,960

[22] Filed: Aug. 24, 1999

[51] Int. Cl.[7] ..... B65D 45/00

[52] U.S. Cl. ..... 220/23.6; 220/729; 206/503; 206/821

[58] Field of Search ..... 220/23.6, 729, 220/319; 206/821, 503

[56] References Cited

U.S. PATENT DOCUMENTS

| | | | |
|---|---|---|---|
| D. 348,836 | 7/1994 | McCallum et al. . | |
| 1,593,633 | 7/1926 | Johnson . | |
| 1,847,245 | 3/1932 | Hothersall . | |
| 3,298,561 | 1/1967 | McConnie . | |
| 3,317,087 | 5/1967 | Landis | 206/821 X |
| 3,624,789 | 11/1971 | Peyser et al. | 206/821 X |
| 3,815,777 | 6/1974 | Churan . | |
| 3,885,672 | 5/1975 | Westenrieder | 206/503 |
| 3,913,785 | 10/1975 | Pattershall . | |
| 4,111,330 | 9/1978 | Jordan . | |
| 4,728,003 | 3/1988 | Davey . | |
| 4,930,636 | 6/1990 | Meadows | 206/821 X |
| 4,932,554 | 6/1990 | Smith et al. . | |
| 4,969,570 | 11/1990 | Harvey, Sr. . | |
| 5,156,273 | 10/1992 | Mortensen | 206/821 X |
| 5,193,705 | 3/1993 | McCallum et al. . | |
| 5,915,557 | 6/1999 | Levine | 206/821 X |

FOREIGN PATENT DOCUMENTS 552834 2/1958 Canada .

*Primary Examiner*—Steven Pollard
*Attorney, Agent, or Firm*—Seyfarth, Shaw, Fairweather & Geraldson; George H. Gerstman

[57] ABSTRACT

A container lid locking ring is provided to secure the lid of a container to the container and lock one container on top of another. The locking ring comprises a cylindrical ring having a first projection for engaging a recess in the lid of a first container and a second projection, having a finger-like projection, for locking about the rim bead of the container. The locking ring further comprises a seat on which an over disposed container may be placed and a third projection, having a finger-like projection, for locking about the bottom rim bead of the over disposed container. The locking ring may further comprise a fourth projection, providing added locking support and sealing capabilities. In the use of the locking ring, containers may have their lids securely locked onto the container and containers may be securely stacked one on top of another for transportation, storage and display.

8 Claims, 3 Drawing Sheets

LOCKING RING FOR CONTAINERS

FIELD OF THE INVENTION

The present invention concerns a novel removable container lid locking ring.

BACKGROUND OF THE INVENTION

Paint and other hazardous chemicals, are often stored, sold and transported in metal cylindrical containers which have friction fit lids. The most well known example of this type of container is the one gallon paint can. While the lids of these containers, which are generally pushed into the top of the container, are adequate to maintain the contents of the container in stable situations, these lids have been found to allow leaks or to come off when the container has been severely jarred, as when it is dropped, knocked over, or hit.

Frequently, these containers are stacked one on top of another for transportation, storage or display. As the containers are generally cylindrical, the stacking arrangement is often unstable when containers are stacked above two or three containers. Further, because of irregularities in the container lids, or when a container has been dropped or jarred causing buckling in the container or its lid, the containers often do not sit well one on top of another causing further instability in the stack. As stacking of these containers may be the preferred method of storage and display, the instability of such stacking often results in containers being knocked over and contents spilling out. Further, as the containers are stacked for transportation, storage and display, it would be desirable to be able to move containers from storage to display in stacked relationship. Because of the instability of stacks of these containers, and because each container is usually just seated on the container bellow it, the usual way of moving containers is to either place them into boxes or to move each container, one by one, from one place to another.

I have invented a novel device that locks the lid of a friction fit container to the container so that the lid can not be easily removed from the container when the container is jarred or falls. Further, the device provides a seat which accommodates the bottom of another container in stacked relationship with the container on which the device is placed, thus eliminating the instability inherent in the stacking of the containers. The device further provides means to lock the first container to the second container increasing the stability of the stack of containers and providing a means to move the entire stack of containers by lifting the top container.

It is therefore an object of the present invention to provide a means for locking the lid of container to the container to facilitate the safe transportation, storage and display of containers of hazardous liquids.

It is a further object of the present invention to provide a seat between a first and second container so that the second container may be securely seated above the first container.

It is a further object of the present invention to provide a means to lock a first container to a second container, disposed above said first container, such that the first and second container may be securely stacked and transported in unison.

Other objects and advantages of the present invention will become apparent as the description proceeds.

SUMMARY OF THE INVENTION

In accordance with the present invention, a container lid locking ring is provided for use with cylindrical containers having top and bottom rim beads. The container lid locking ring comprises a cylindrical ring having a first projection for engaging a recess in the lid of a container and a second projection, comprising a finger-like projection, for locking about the rim bead on the top of the outside wall of the container, such that said lid is securely held on the container.

The cylindrical ring further comprises a seat for engaging the bottom of an over disposed container and a third projection, comprising a finger-like projection, for locking about the rim bead on the bottom of the outside wall of the over disposed container, such that the container and the over disposed container are locked together.

In one embodiment, the cylindrical ring comprises a fourth projection, disposed between the first and second projection. The fourth projection cooperates with the first and second projections, of the locking ring, to provide additional locking support and liquid sealing between the lid and the container.

In the illustrative embodiment the cylindrical ring is made of a plastic material which is generally rigid and slightly resilient, so that it is flexible enough to be placed on a container yet strong enough to lock the lid onto the container and lock a second container onto the first.

A more detailed explanation of the invention is provided in the following description and claims and is illustrated in the accompanying drawings.

DETAILED DESCRIPTION OF THE ILLUSTRATIVE EMBODIMENTS

Figure 1:
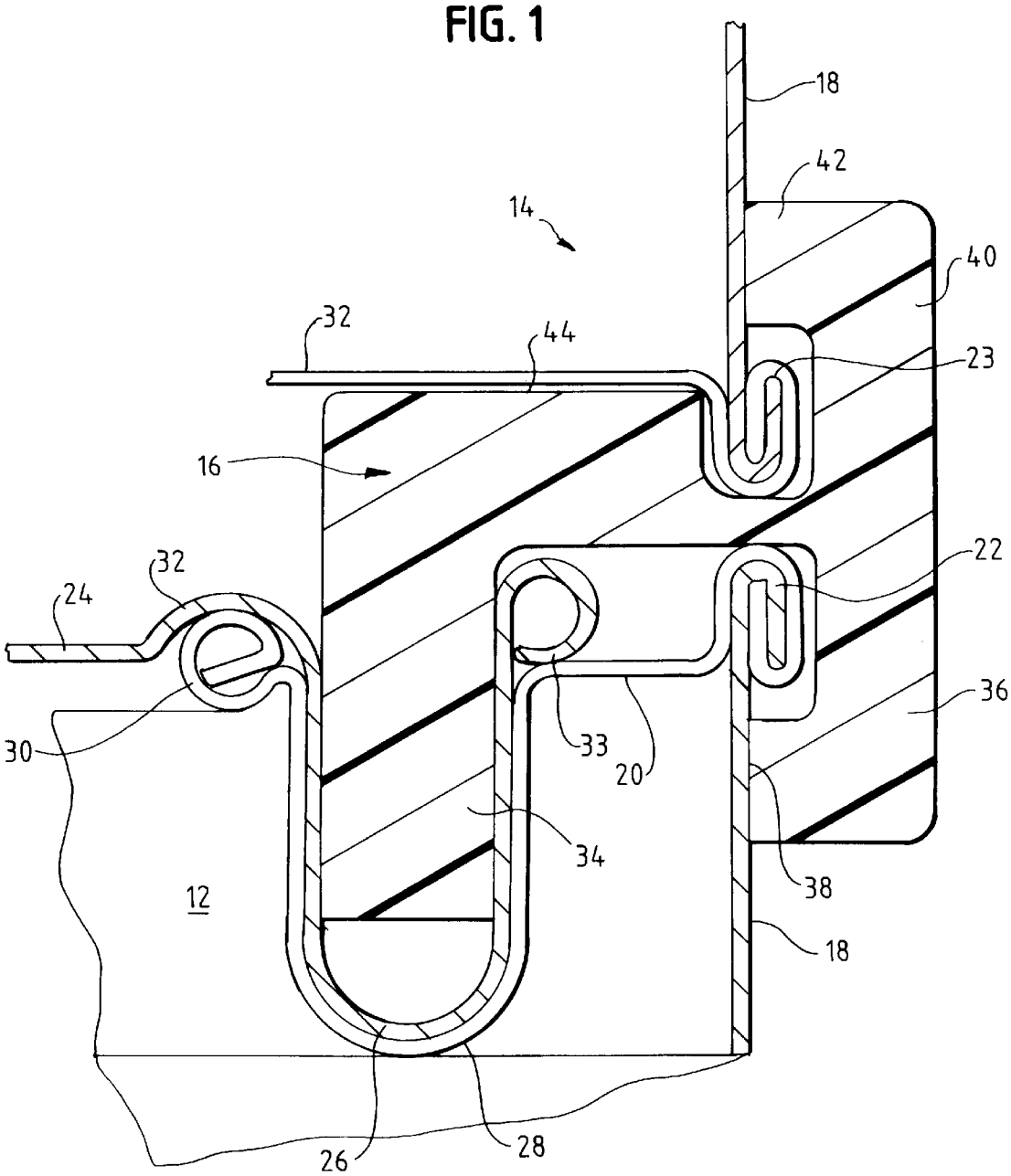
FIG. 1 is a cross sectional view of a container locking ring made in accordance with the teachings of the present invention, shown in use on containers.

Referring to the drawings, a container lid locking ring 10 is provided for attachment to a first container 12 and a second container 14. Locking ring 10 comprises a generally cylindrical ring 16. In the illustrative embodiment, ring 16 is made of generally rigid but slightly resilient plastic material. It is to be understood, however, that ring 10 may be made of any material sufficiently flexible to be bent around the various features of containers 12 and 14 and elastic enough to return to its original shape so that it may lock the container lid and containers in place.

Containers 12 and 14 are of a well known type, the most common example of which is the one gallon paint container. Containers 12 and 14 each have a cylindrical wall 18 joined to a top 20 in a well known manner. The joinder of top 20 and wall 18 forms a rim bead 22 about the top of wall 18. Containers 12 and 14 are further provided with a friction fit lid 24, generally comprising a disc having a U-shaped recess 26. Top 20 comprises a U-shaped channel 28 into which U-shaped recess 26 fits to form a generally liquid-proof seal between top 20 and lid 24. Top 20 further comprises an inner rim bead 30, to provide a finished end for top 20 and for further engagement with lid 24. Lid 24 further comprises a raised annular portion 32, which fits above top 20 inner rim bead 30, and a rim bead 33, which finishes the edge of lid 24. The joinder of cylindrical wall 18 to container bottom 32, in each of containers 12 and 14, forms a rim bead 23 about the bottom of wall 18 in a manner similar to that formed on the top of wall 18.

Locking ring 10 further comprises a first projection 34 which engages U-shaped recess 26 in lid 24. In the illustrative embodiment, first projection 34 is sized to fit tightly within recess 26 to assist in locking lid 24 to top 20. A second projection 36, having a finger-like portion 38, depends from cylindrical ring 16. Second projection 36 fits about rim bead 22, when ring 10 is placed onto container 12. The flexibility of ring 10 allows finger-like projection 38 to be bent back so that it may be placed around rim bead 22. The elasticity of ring 10 causes finger-like projection 38 to snap back to its original shape, under bead rim 22, aiding in locking ring 10 into place and assisting in the sealing of lid 24 to top 20.

A third projection 40, having a finger-like projection 42, projects from cylindrical ring 16, directly above second projection 36. Third projection 40 fits about rim bead 23 of overly disposed container 14, in a manner similar to the fitting of projection 36 to rim bead 22. In this manner over disposed container 14 is locked to container 12 so that stability in stacking and ease in moving more than one container is achieved. A seat 44 is provided on cylindrical ring 16 to provide support for the bottom of container 14 when it is stacked onto container 12. The combination of locking projection 40 about rim bead 23 of container 14 and placing container 14 on seat 44, provides a secure and stable means of stacking and transporting any number of containers connected in this fashion.

Figure 2:
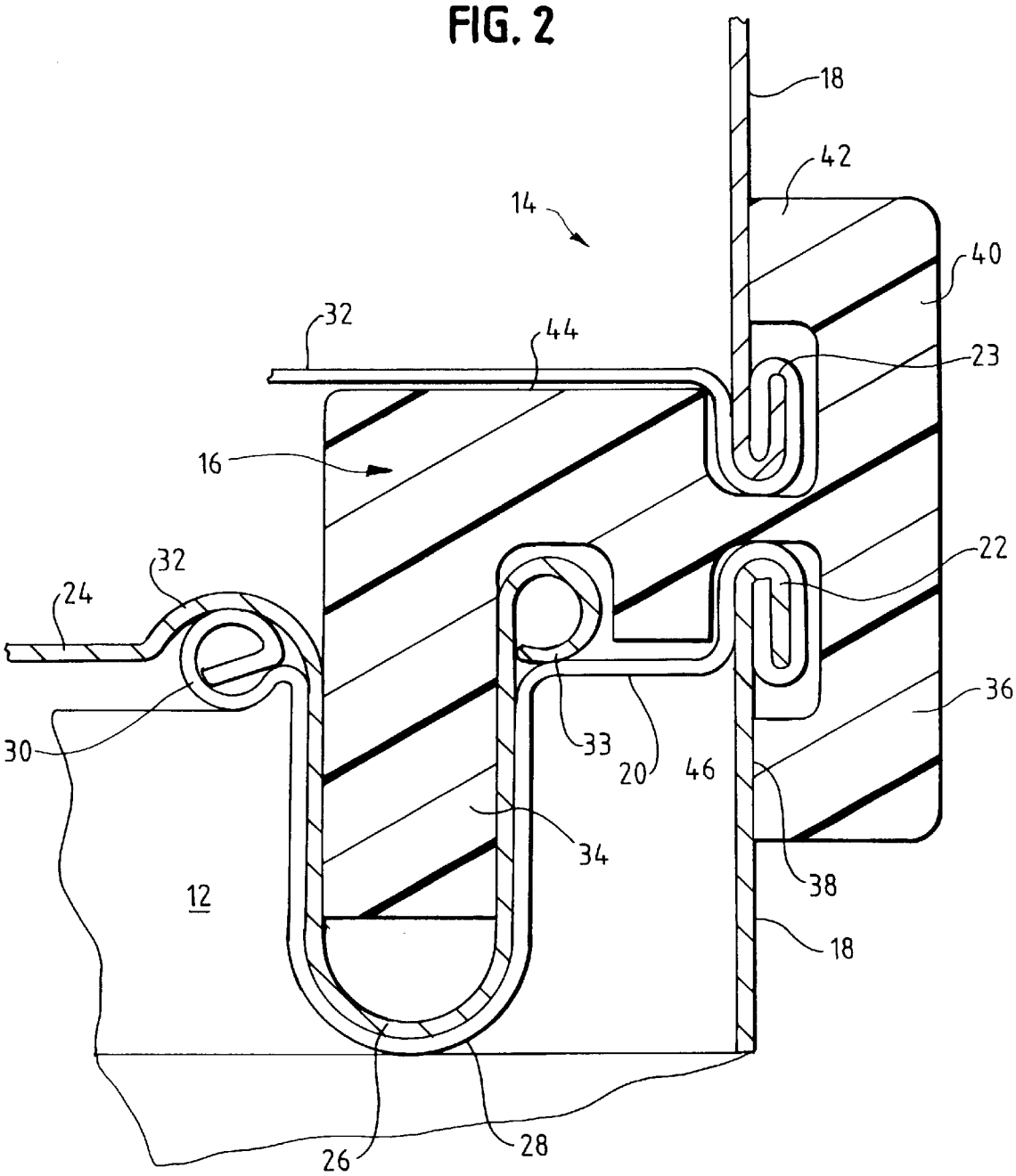
FIG. 2 is a cross sectional view, similar to FIG. 1, of another embodiment of a locking ring of the present invention.
Figure 3:
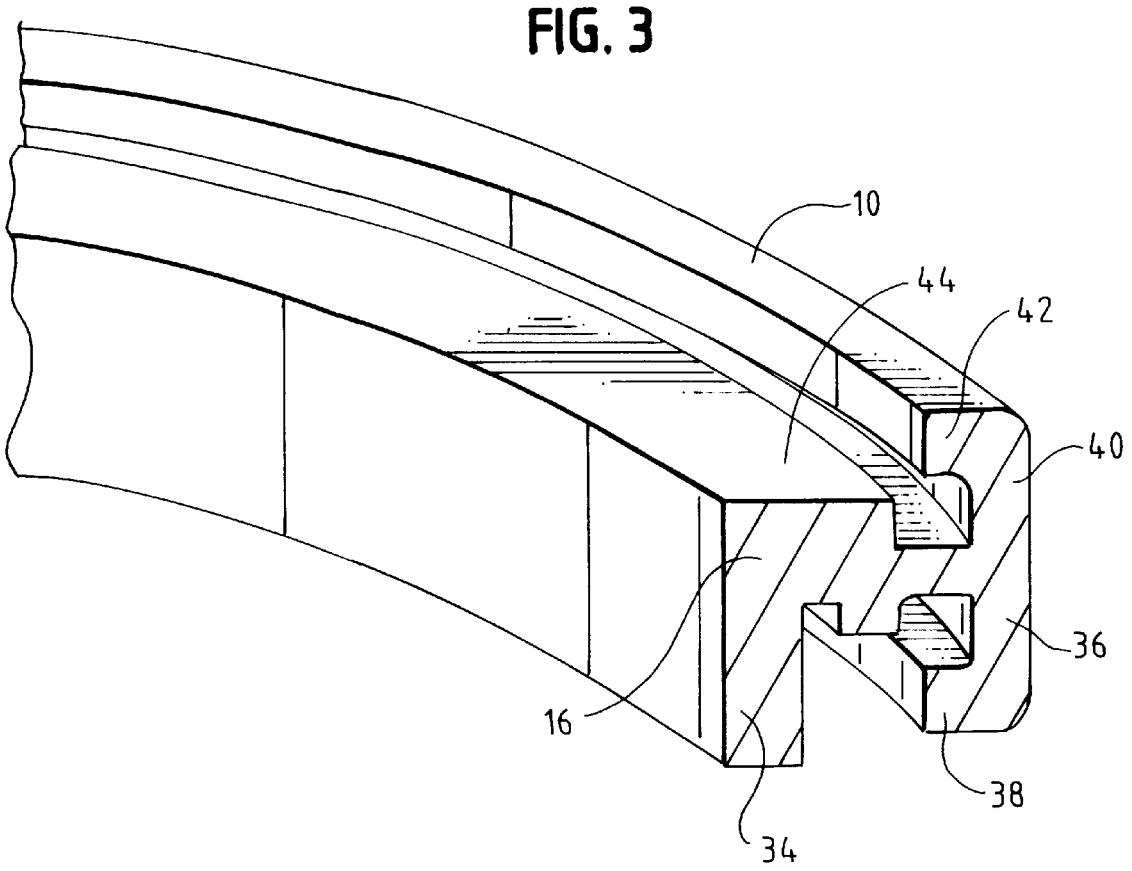
FIG. 3 is a perspective view, partially cut away, of the container locking ring of FIG. 2.

In one embodiment, shown in FIG. 2, a fourth projection 46 depends from cylindrical ring 16 above top 20 between rim bead 33, of lid 24, and rim bead 22, of top 20. Fourth projection 46 strengthens the locking of ring 10 to container 12 and provides an added seal against loss of the contents of container 12.

In utilizing the present invention, locking ring 10 is placed onto the top of first container 12 by pushing first projection 34 into channel 26. If an embodiment of the present invention is used having fourth projection 46 (see FIG. 2.), fourth projection 46 enters the space between rim bead 33 and rim bead 22, to eventually form an added sealing element upon the complete installation of ring 10. Second projection 36 is then bent out so that finger-like projection 38 can be pulled around rim bead 22. When second projection 36 is released, finger-like projection 38 returns to its original position, now snapped in under rim bead 22. Lid 24 is now tightly secured to container 12. Third projection 40 may now be bent back and a second container 14 may then be placed on seat 44. Bending of third projection 40 allows finger-like projection 42 to be placed above rim bead 23 of container 14, such that when third projection 40 is released, container 14 is locked to ring 10 and container 12. This process of connecting containers to one another may be followed for any number of containers above and below first container 12. In this manner the contents of the containers are secured, the containers are securely seated on one another and locked together so that they cannot be easily toppled and may be transported in unison.

Although illustrative embodiments of the invention has been shown and described, it is to be understood that various modifications and substitutions may be made by those skilled in the art without departing from the novel spirit and scope of the invention.

What is claimed is:

1. A container lid locking ring, for use with cylindrical containers having top and bottom rim beads, comprising:

a cylindrical ring having a first projection for engaging a recess in the lid of a container and a second projection, comprising a finger-like projection, for locking about the rim bead on the top of the outside wall of the container, such that said lid is securely held on the container;

said cylindrical ring further comprising a seat for engaging the bottom of an over disposed container and a third projection, comprising a finger-like projection, for locking about the rim bead on the bottom of the outside wall of the over disposed container, such that the container and the over disposed container are locked together.

2. The container lid locking ring of claim 1, wherein said cylindrical ring comprises a fourth projection, disposed between said first and second projection, said fourth projection cooperating with said first and second projections to provide additional locking support and sealing for a lid and container.

3. The container lid locking ring of claim 1, wherein said locking ring is composed of generally rigid, slightly resilient material.

4. The container lid locking ring of claim 1, wherein said locking ring is composed of plastic.

5. The container lid locking ring of claim 1, wherein said first projection fits tightly within a recess in a container lid.

6. The container lid locking ring of claim 1, wherein said ring is configured for use with a standard one gallon cylindrical container.

7. A container lid locking ring, for use with cylindrical containers having top and bottom rim beads, comprising:

a cylindrical ring, formed of plastic, having a first projection for tightly engaging a recess in the lid of a container and a second projection, comprising a finger-like projection, for locking about the rim bead on the top of the outside wall of the container, such that said lid is securely held on the container;

said cylindrical ring further comprising a seat for engaging the bottom of an over disposed container and a third projection, comprising a finger-like projection, for locking about the rim bead on the bottom of the outside wall of the over disposed container, such that the container and the over disposed container are locked together; and a fourth projection, disposed between said first and second projection, said fourth projection cooperating with said first and second projections to provide additional locking support and sealing for the lid and container.

8. The container lid locking ring of claim 7, wherein said ring fits on a standard one gallon cylindrical container.

* * * * *